US008124896B2

(12) United States Patent
Ruff

(10) Patent No.: US 8,124,896 B2
(45) Date of Patent: Feb. 28, 2012

(54) SLIDING CONTACT SWITCH

(75) Inventor: Eduard Ruff, Auerbach (DE)

(73) Assignee: ZF Friedrichshafen, AG, Friedrichshafen (DE)

( * ) Notice: Subject to any disclaimer, the term of this patent is extended or adjusted under 35 U.S.C. 154(b) by 691 days.

(21) Appl. No.: 12/287,465

(22) Filed: Oct. 9, 2008

(65) Prior Publication Data

US 2009/0095609 A1 Apr. 16, 2009

(30) Foreign Application Priority Data

Oct. 10, 2007 (DE) ..... 10 2007 048 581

(51) Int. Cl.
*H01H 1/36* (2006.01)

(52) U.S. Cl. ..... 200/252; 200/275

(58) Field of Classification Search ..... 200/252, 200/275, 279

See application file for complete search history.

(56) References Cited

U.S. PATENT DOCUMENTS

| | | | | |
|---|---|---|---|---|
| 2,785,240 | A * | 3/1957 | Carling | 200/16 D |
| 4,376,234 | A * | 3/1983 | Liataud et al. | 200/16 R |
| 4,704,503 | A * | 11/1987 | Takasawa | 200/16 B |
| 4,841,105 | A * | 6/1989 | Goodman et al. | 200/16 D |
| 5,155,306 | A * | 10/1992 | Iijima et al. | 200/11 DA |
| 6,610,939 | B2 | 8/2003 | Watada | |
| 6,630,636 | B2 * | 10/2003 | Nakamura | 200/16 R |
| 7,442,895 | B2 * | 10/2008 | Bauer et al. | 200/531 |
| 2007/0062796 | A1 | 3/2007 | Bauer et al. | |

FOREIGN PATENT DOCUMENTS

| | | |
|---|---|---|
| DE | 1 904 616 | 8/1970 |
| DE | 10 2006 011 930 | 2/2007 |
| EP | 1 241 693 | 9/2002 |
| EP | 1 764 813 | 3/2007 |

* cited by examiner

*Primary Examiner* — Anh Mai
*Assistant Examiner* — Lisa Homza
(74) *Attorney, Agent, or Firm* — Jordan and Hamburg LLP

(57) ABSTRACT

An electrical sliding contact switch having a housing in which a common contact body and at least one selective contact body having a contact surface are arranged. A sliding area including electrically insulating material is arranged adjacent to the contact area of the selective contact body. A contactor that is in continuous electrically conducting connection with the common contact body and has at least one sliding contact is either in electrically conducting connection with the selective contact body or touches the sliding area. An actuating member is furthermore arranged in the housing such that upon actuation, it slidingly moves the at least one sliding contact of the contactor on a sliding path from the contact surface of the selective contact body into the sliding area and/or out of the sliding area to the contact surface of the selective contact body. Furthermore, embodied in the sliding path, are zones that are not touched by the sliding contacts during transit of the sliding area.

16 Claims, 5 Drawing Sheets

SLIDING CONTACT SWITCH

BACKGROUND OF THE INVENTION

The invention relates to an electrical sliding contact switch, in particular, a microswitch, miniature switch, or subminiature switch, the switch positions of which are changed by sliding movement by the contact body.

Electrical sliding contact switches of this type act as microswitches, miniature switches, or subminiature switches in many application fields such as, for example, in automobile instrument engineering and household appliances. In these switches, sliding contacts are brought from one contact point to another contact point in a sliding movement. The electrically conducting connection is only meant to occur at the respective contact points.

Known from DE 10 2006 011 930 B3, is an electrical sliding contact switch having a pivotably borne contact rocker. The known switch has a base made of an electrically insulating plastic and a cover. The voltage is applied to a common contact body that is continuously in electrically conducting connection with a contact rocker borne thereon. The contact rocker has two pairs of contact fingers that pass over the contact areas on two selective contact bodies. An adjusting spring in a C or W shape pulls the contact rocker into a first inclined position in which the switching fingers are positioned on both sides of the contact area of the first selective contact body. When an actuating member is pressed, which member is displaceable in the cover and sealed by a sealing collar, the contact rocker is forced into its opposite second pivot position in which the contact fingers are positioned on both sides of the contact area of a second selective contact body.

EP 1 764 813 A1 describes an electric switch having a common contact body, a first selective contact body, and a second selective contact body. A contactor is connected, mechanically and electrically conducting, to the common contact body. The contactor comprises an elastic electrically conducting material. The contactor is pre-stressed such that the contact fingers are positioned against the contact surfaces of the first selective contact body. Pressing the contactor elastically deforms it and pivots it, with the contact fingers, such that the contact fingers switchingly enclose the contact surfaces of the second selective contact body.

It is disadvantageous in the prior art that the sliding movements of the sliding contacts on the housing areas between the selective contact bodies can cause metal deposits that themselves can produce a conducting connection between the individual selective contact bodies. These deposits are amplified by soilage and by melting loss of lubrication grease or oil, so that the sliding path formed by the sliding contacts in the sliding area of the housing can produce a conducting connection.

As the wear progresses on the sliding contacts, which in their original condition preferably have the shape of a spherical cap, the sliding contacts in the prior art switch become increasingly flat so that over time the initial point contact of the sliding contact becomes a surface contact. The outcome of this is that the pressure/surface pressure of the sliding contacts on the selective contact bodies grows increasingly smaller because the support surface of the sliding contacts becomes increasingly larger and therefore increasingly poorer contact certainty is attained.

However, the flattening of the sliding contacts with increasing wear also results in the switching point displacing because the support surface becomes larger. In an extreme case, this can result in simultaneous contact of one sliding contact on two selective contact bodies and can lead to a short circuit. In order to avoid this, the distance between the selective contact bodies must be selected to be large enough that this effect is accounted for. Because of this, when new, there can be long change-over paths (dead zones) in the switch that become shorter as the useful life progresses, i.e., with increasing wear of the sliding contacts. This also results in a switching time that decreases as the useful life of the switch progresses, i.e., the switching times of the known switch cannot be kept constant. This results in relatively wide switching point tolerances that must be maintained over the service life of the switch.

The underlying object of the invention is therefore to create an electric switch of the aforesaid type in which the switching process can be optimally configured corresponding to the electrotechnical and mechanical requirements so that, despite economic production, years-long, reliable continuous operation is assured.

SUMMARY OF THE INVENTION

This object is attained using an electrical sliding contact switch which includes a common contact body, at least one selective contact body having a contact surface, a sliding area that includes an electrically insulating material and that is adjacent to the contact surface of the selective contact body, a contactor having a contact which is in continuous electrically conducting connection with the common contact body and has at least one sliding contact that is in electrically conducting connection with the selective contact body or that touches the sliding area depending on a positioning thereof when moved, and an actuating member that, upon actuation thereof, slidingly moves the at least one sliding contact of the contactor on a sliding path between the contact surface of the selective contact body and the sliding area, wherein zones are formed in the sliding path that are not contacted by the sliding contact when it transits the sliding area.

Proceeding from the genre-forming switch in accordance with DE 10 2006 930 B3, in the inventive switch, a contactor is also slidingly brought between selective contact bodies from one switch position to another switch position. At one end, the contactor is continuously in electrically conducting connection with a common contact body, which normally represents a ground connection. Embodied on the contactor are sliding contacts that produce the electrical contact with selective contact bodies in the respective switch positions. When the actuating switch or member is actuated, these sliding contacts are slidingly moved out of contact with a first selective contact body and slidingly brought into contact with a second selective contact body, the sliding contact being conducted away between the two selective contact bodies via a sliding area. The inventive switch has two selective contact bodies, although this is not necessary. For instance, as a simple on/off switch, the inventive sliding contact switch can also have only one selective contact body, the sliding contact sliding back and forth between an electrically non-conducting sliding area and the contact surface of a selective contact body.

In order to ensure that, when the switch is operated, no contact path or conductor path is built up on the sliding area between the two selective contact bodies and the sliding area due to abrasion on the sliding contact, the contact path(s) of the sliding contact(s) is/are intentionally interrupted. This occurs, for instance, by adding to the sliding area a rib or groove that intersects the sliding path, in accordance with the invention. Such a configuration of the sliding area between two selective contact bodies or the selective contact body and a non-conducting base position for the sliding contact will prevent the sliding path from being continuous. Thus, it is not possible for an electrical connection to be produced between the selective contact bodies by deposits that can be metal abrasion from the sliding contacts and/or can be soilage.

What is attained by arranging a rib transverse to the direction in which the sliding contacts move is that in the area of the transition of the sliding surface to the surface of the rib the sliding contact does not touch the rib in the area in which it connects to the sliding surface, that is, at the foot of the rib, while the sliding contact moves past the rib. Due to its rounded shape, having a radius that is greater than the radius of the point at which the rib is connected to the sliding surface, the sliding contact cannot penetrate to the base of the rib. Because of this an interruption occurs in the sliding path on each side of the rib, and abrasion and/or soilage cannot produce any conducting connection in this interruption. Thus, it is simply not possible to form a conducting connection between the selective contact bodies via the rib. At the same time, the support point for the sliding contact changes continuously as the rib is traversed so that any abrasion that occurs happens uniformly on the complete surface of the sliding contact.

Even though the shape of the rib can, to a large degree, be freely determined, it is still necessary to ensure that the sliding contact and the rib are configured such that at the instant in which the sliding contact touches the rib and is not yet raised from the sliding area there is a gap between sliding contact and rib base and the sliding contact cannot penetrate into this gap. As indicated in the foregoing, this gap interrupts the sliding track between the selective contact bodies and in addition lubrication grease or oil can collect in this gap and thus improve lubrication of the sliding contact. Lubrication grease used will preferably collect at base of the rib and distribute along the rib so that lubrication oil or grease for lubricating the sliding contact can be picked up each time the sliding contact passes by.

That which was described in the foregoing using the example of a rib in the switching area of the housing also applies analogously and likewise for grooves that are added to the sliding area. In contrast to the embodiment with ribs that project from the sliding area, in which embodiment the sliding path is interrupted on both sides of the rib, when a groove is added to the sliding area the sliding path is interrupted only once. At the base of the groove, which the sliding contact does not touch, there is no mechanical contact with the sliding contact and thus here as well there can be no melting of the abrasion, creating a conducting path. The shape of the groove can be selected as desired as long as it is ensured that the sliding contact cannot penetrate into the groove base.

As in the embodiment with the rib-like convexities or projections from the sliding area, the lubrication oil or grease used collects in groove-like concavities. Thus, the groove also acts as a type of reservoir for the lubrication agent used.

Adding grooves or ribs also results in the additional advantage of tactile feedback that occurs when the sliding contact passes over the groove or rib. This can be used for discerning a switching state, for instance a base position for the switch. This is particularly simple given a constriction, because the sliding contacts are pressed slightly into the concavity due to the pressing force and it is possible to perceive an increase in the resistance to further movement by the sliding contacts.

Thus, for instance, a center zero position is possible that can be a base position for the switch. But such an effect can also be attained by arranging two ribs one after the other. In this case, when the sliding contact crosses the first rib, the tactile feedback can be used to determine a non-conducting position of the sliding contact after leaving the selective contact and, conversely, a conducting connection on a selective contact body can be detected after leaving the sliding area. Thus, a switch position having a conducting electrical connection or a position having a non-conducting connection can be determined in a simple and reliable manner. Thus, for instance, the non-conducting sliding area, also called an insulator, is arranged in a so-called center zero position between two conducting areas, each of which are associated with a selective contact body or even belong to just a single contact body (selective contact body). In the center zero position, the sliding contact of the contactor is located in the sliding area of the insulator, so that no passage occurs in the switch.

All known switch positions or switch conditions can be realized with the invention, as with switches that are known from the prior art, in particular, the sliding contact can be brought from one position in a non-conducting sliding area into a conducting contact area on a (selective) contact body and from there can be brought further into another sliding area, for example, of another insulator, or back to the (starting) insulator. The inventive switch can also be moved to another selective contact body from a switching or base position, in which the contactor, using at least one sliding contact, is in conducting connection with a selective contact body, and thus, there is a passage through the switch, via a sliding area, while no passage occurs through the switch, a passage then through the switch then occurring again. The contactor, using another contact point, is in continuous electrically conducting connection with a contact body that is common for the selective contact bodies and that normally represents the ground contact for the switch.

By adding at least one rib or groove, the change-over point from one selective contact body to another selective contact body can be precisely defined, because in addition to the sliding movement running in the plane of the sliding areas, there is a movement away from the sliding surface that permits a defined switching point. This additional movement also makes it possible for the distances between the selective contact bodies to be configured in an optimal manner in order to thus enable more rapid and more precise switching. In addition, the switching course remains largely constant, regardless of the number of switching cycles. Shortening the dead zone due to flattening of the initially round sliding contact and the associated enlargement of the contact surface practically does not occur with the inventive switching design.

With regard to the configuration of the contactor, its sliding contacts, and its movements, i.e., movements of the sliding contacts on the sliding path in the sliding area, there are a number of possibilities that are all encompassed by the inventive idea, as long as the movement path/sliding path that the sliding contact leaves in the electrically non-conducting sliding area is interrupted by the addition of an elevation or depression so that zones that the sliding contact does not touch are present in the sliding area and/or on the surface of the elevation or depression. Since, in accordance with the inventive idea, modification of already existing electrical sliding switch concepts is permitted, such modified electrical sliding contact switches are also encompassed by the inventive idea.

Likewise, the invention is not limited to switches that switch back and forth between two selective contact bodies with an electrically non-conducting sliding area arranged therebetween or that switch from an electrically non-conducting sliding area to an electrically conducting area and vice versa, but rather, it is readily evident to one skilled in the art that the inventive idea can also be applied in rotary sliding contact switches, potentiometers, and rotary switches. The same applies for linear switches that have a purely linear movement for the contactor or the sliding contacts from a first position to a second position. Naturally, switches that perform a combination of linear and rotary movements of the sliding contacts and that in doing so pass over elevations or depressions in non-conducting areas are also encompassed by the inventive idea.

In addition, the manner in which the contactor is moved from one contact position on a selective contact body via the barrier on the sliding area of the housing to another contact position of a selective contact body is encompassed by the inventive idea in every possible embodiment. It does not matter whether the contactor is elastically pre-stressed or is brought into an elastically pre-stressed position or is simply pushed, pulled, or rotated from one area to the next area without any elastic deformation. In all of these instances the inventive idea is even realized when a geometric obstacle, for example, in the shape of a rib or a groove, is added between two switch positions for a sliding contact and interrupts the sliding path so that no conducting connection is built up through the sliding path between two adjacent areas.

The invention and refinements of the invention are described in greater detail in the following using the drawings of one exemplary embodiment.

DETAILED DESCRIPTION OF THE INVENTION

Figure 1:
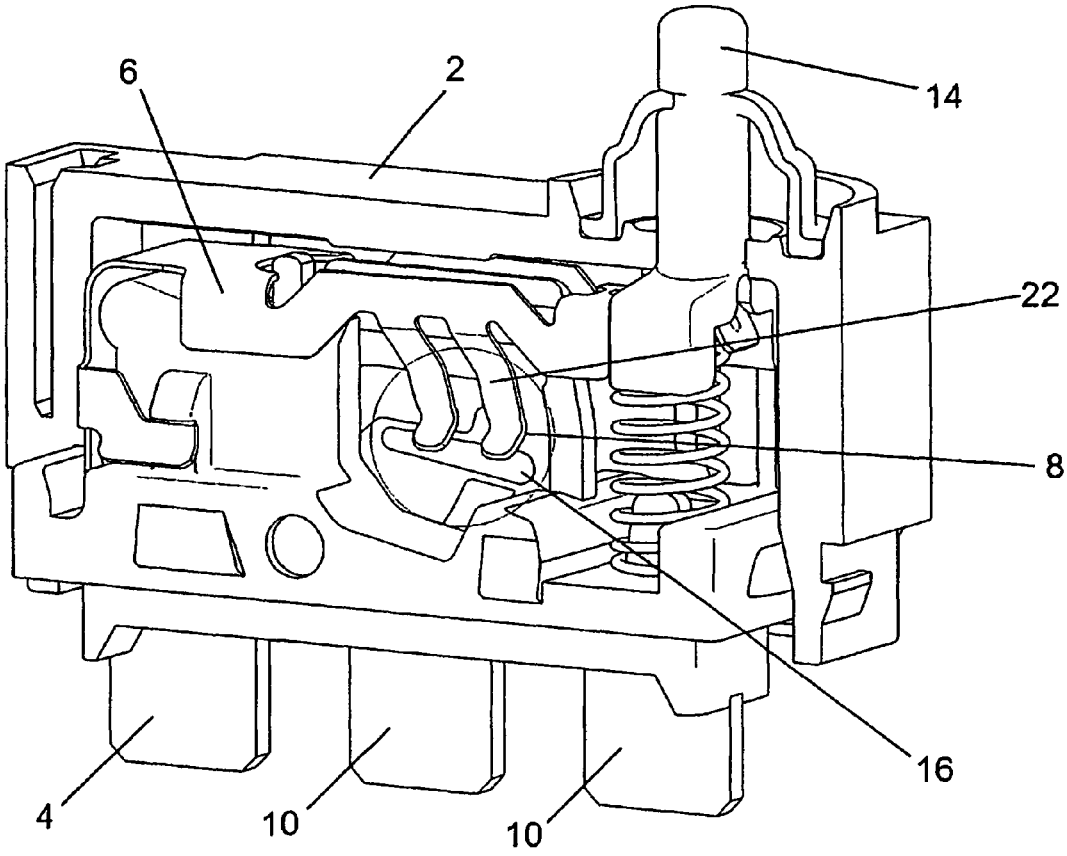
FIG. 1 is a perspective elevation of an inventive switch with the switch removed.

FIG. 1 depicts a sliding contact switch as it is known from the aforesaid prior art, but with a rib added to the sliding area. The switch depicted has a housing 2 in which a common contact body 4 and two selective contact bodies 10 are arranged with their broad sides flat adjacent to one another such that one end of each of the three contact bodies projects from the housing. In the housing 2, the common contact body 4 and the two selective contact bodies 10 are arranged or embedded in the housing 2 such that there is no conducting connection between them. A contactor 6 is in continuous electrical conducting connection with the contact body 4. The contactor can be switched back and forth elastically between the contact surfaces 11 of the selective contact bodies 10 using an actuating member 14. The contact surfaces 11, which are disposed on both sides of the selective contact bodies 10, are enclosed, elastically pre-stressed, by contact fingers 22 that are disposed on the contactor 6. Pressing the actuating member 14 into the switch causes the sliding fingers 22 to slide from a first selective contact body 10 across a sliding area 20 to a second selective contact body 10.

Figure 2:
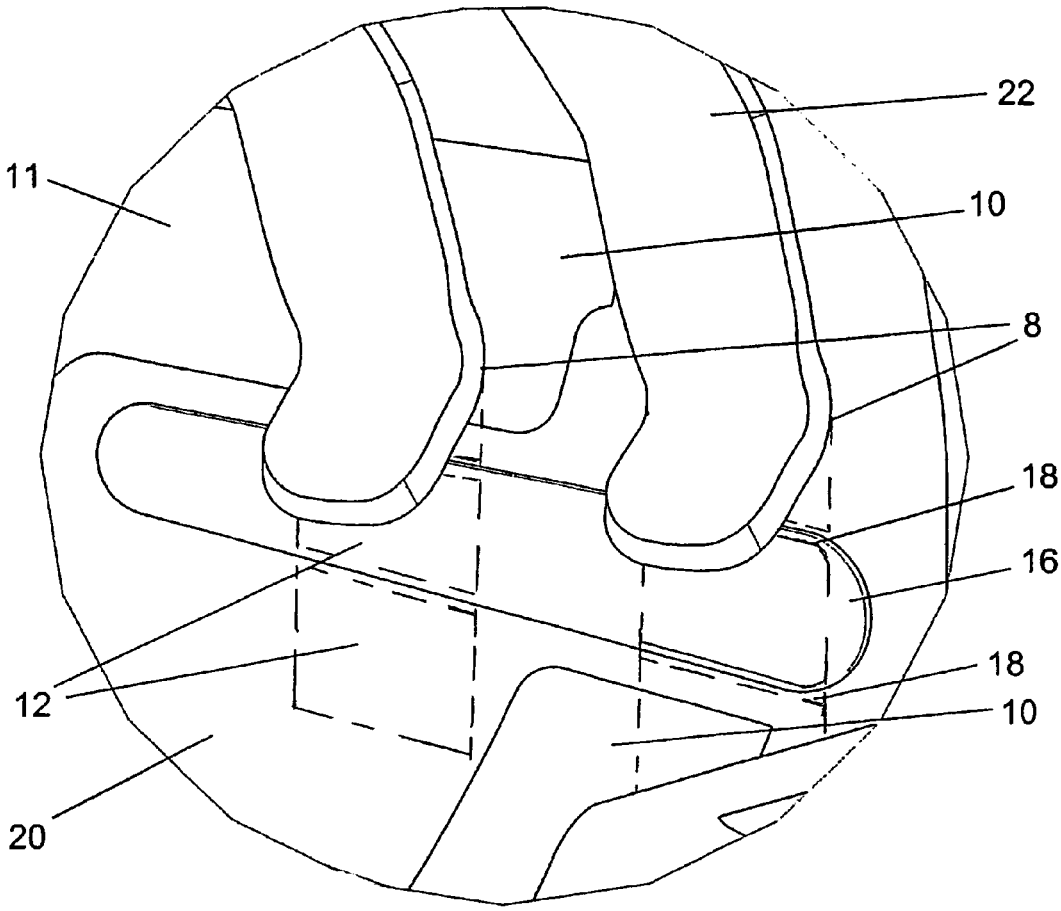
FIG. 2 is an enlarged detail view from FIG. 1 in which the area between two switch positions is shown.

As can be seen from the detail in FIG. 2, when they move from one selective contact body to the other selective contact body the sliding fingers 22 cross a rib 16 that is arranged in the sliding area 20 approximately transverse to the direction of movement. In FIG. 2, broken lines indicate each of the sliding paths 12 for the sliding contacts 8. It can be seen that the sliding path 12 is interrupted both prior to and after the rib 16, as seen from the direction of motion of the sliding fingers 22.

Figure 3:
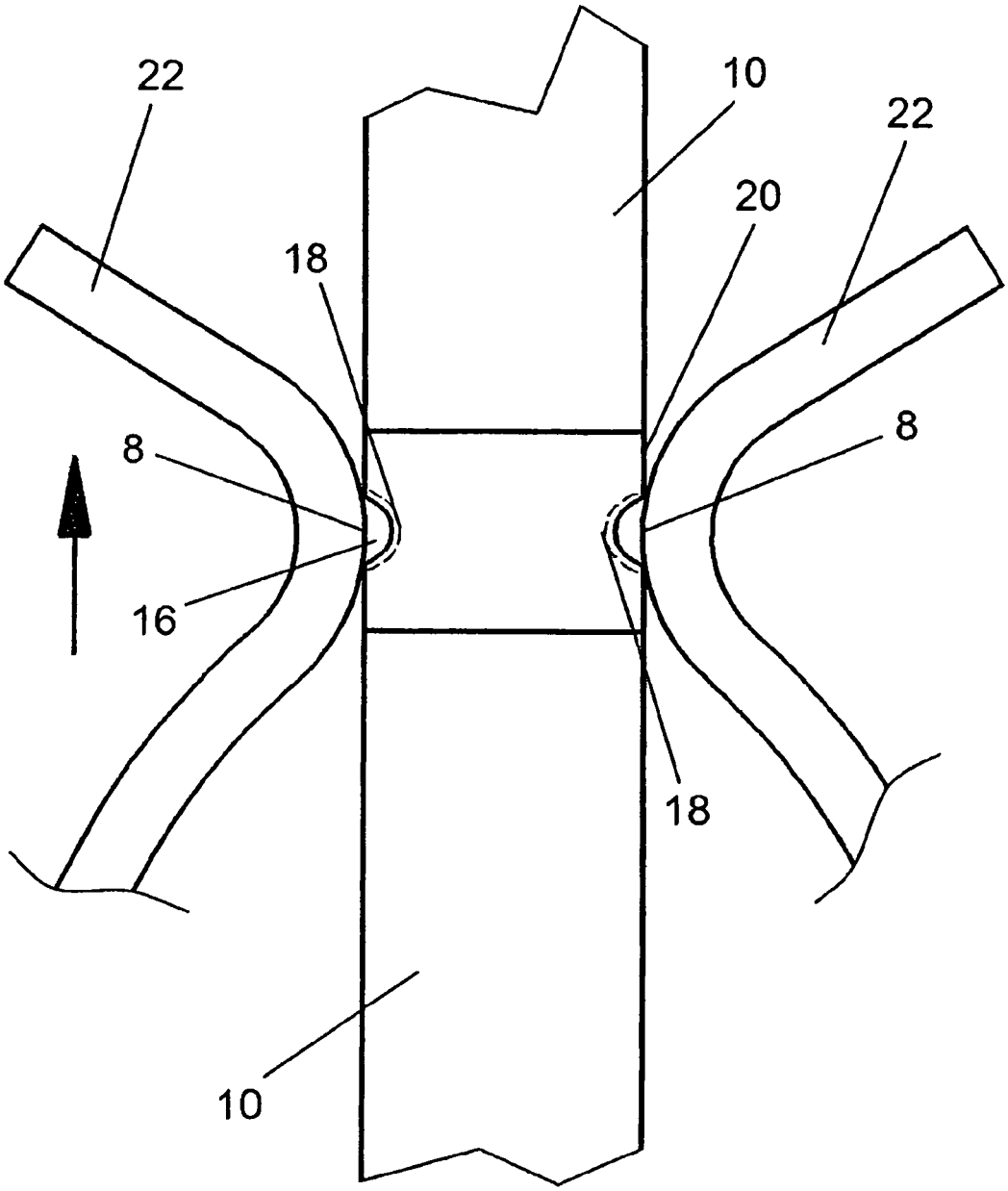
FIG. 3 is a side view of a sliding area between two selective contact bodies having an added groove.
Figure 4:
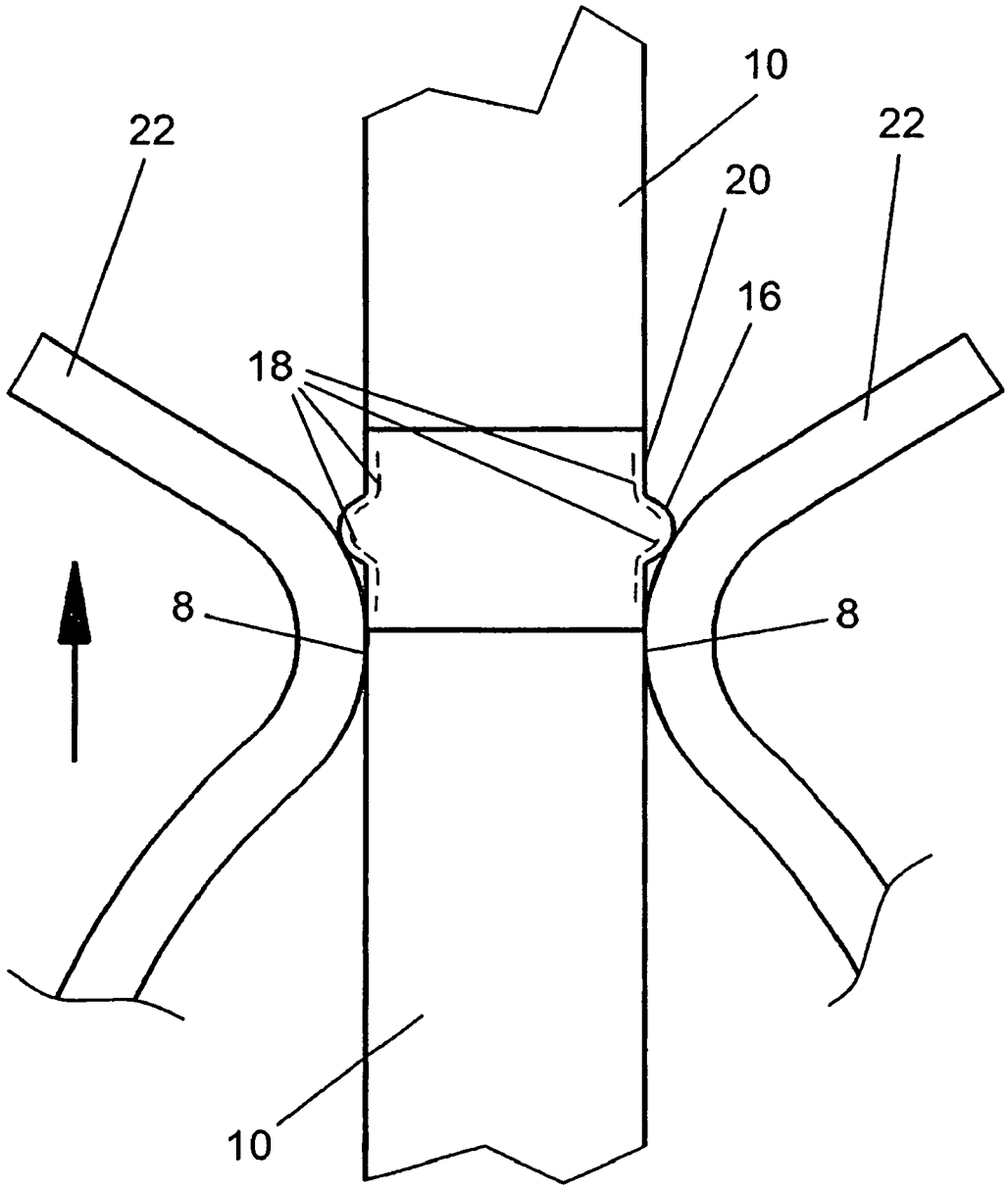
FIG. 4 is a side view of a sliding area between two selective contact bodies having an added rib.

As can be seen particularly well in FIGS. 3 and 4, these interruptions 18 in the sliding path 12 occur in that in these zones, the sliding fingers 22 do not touch the sliding area 20.

In FIG. 4, the two sliding fingers 22 are depicted in the position in which they just touch the rib 16. As the sliding fingers 22 continue to move in the direction of the arrow shown in FIGS. 3 and 4, the sliding fingers 22 lift up from the sliding area 20 and traverse the rib 16. At the instant the contact fingers 22 touch the rib 16, as is depicted in FIG. 4, there are, between the contact fingers 22 and the sliding area 20, contact-free zones 18 into which the sliding contact 8 cannot enter. The sliding contact 8, which in the depiction in FIG. 4 is still touching the selective contact body 10, moves away from the sliding area 20 when the contact fingers 22 continue on. Thus, the contact finger 22 changes its standing point to a support point that is further forward when seen in the direction of motion.

How this support point for the sliding fingers 22 on the rib slowly migrates backward, as seen from the direction of motion, is readily apparent from FIG. 4, as the contact fingers continue in the direction of the arrow. At the end of the rib 16, the contact fingers are positioned against the sliding area again due to their immanent pre-stress force, and can then be moved further in a sliding movement to the second selective contact body 10.

Figure 5:
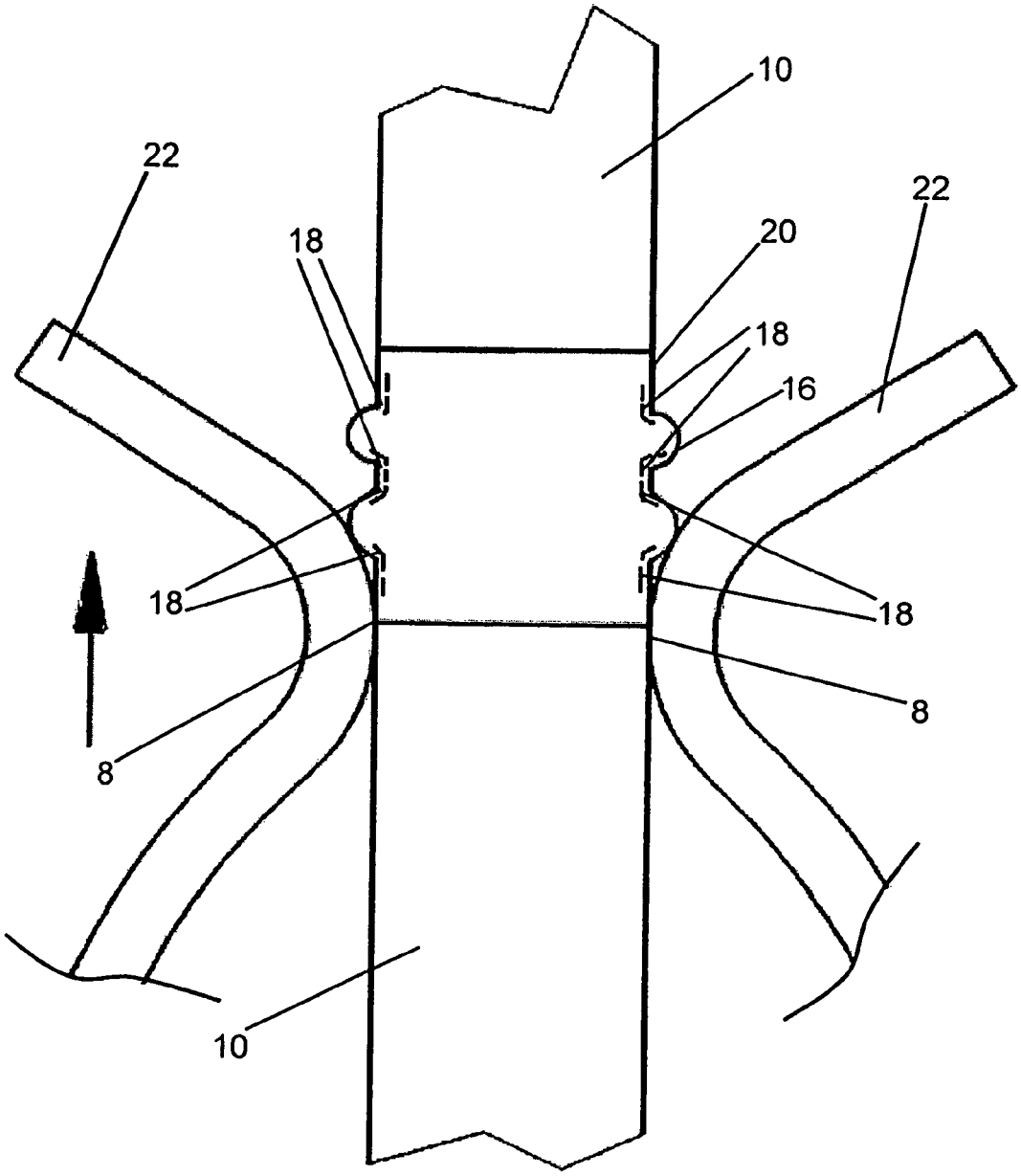
FIG. 5 is a side view of a sliding area between two selective contact bodies having two added ribs.

In another exemplary embodiment depicted in FIG. 5, provided in the sliding area 20 are two ribs 16 that, for example, can act to hold the sliding fingers 22 in a defined position. They can then be deflected in both directions from this position in order to create a conducting connection both with the first selective contact body 10, and also with the second selective contact body 10.

The sliding area 20 is a part of the housing in this exemplary embodiment, i.e., the selective contact bodies are embedded in the housing such that the area 20 between them is filled with housing material. This can be accomplished, for example, during the housing injection molding process, and care must be taken that the contact surfaces 11 of the selective contact bodies are not covered with injection molding material. The rib 16 or the groove 16 can also be embodied in the housing at the same time that the selective contact bodies are embedded in the housing, as is depicted in FIG. 3.

The embodiment in accordance with FIG. 3 depicts, as does FIG. 4, the principle of the slidingly moved contact fingers from one selective contact body 10, via a sliding area 20, to a second selective contact body 10. The sliding contacts 8, which are attached to the contact fingers 22, traverse a groove 16. The groove 16 has zones 18 in the groove base that the sliding contacts 8 cannot reach. Thus, in this case, as well, the sliding path of the sliding contacts 22 is simply and reliably interrupted by a constructive measure.

The principle of interrupting the sliding paths with contactless zones 18 is depicted here using the example of a NO/NC switch, but this represents only one of a great number of embodiments.

The invention claimed is:

1. An electrical sliding contact switch, comprising:

a housing;

a common contact body;

at least one selective contact body having a contact surface, said common contact body and said at least one selective contact body being in a form of flat disk-shaped bodies arranged in a row such that wide sides thereof collectively lie on a common plane;

a sliding area that comprises an electrically insulating material and that is adjacent to said contact surface of said selective contact body;

a contactor having a contact which is in continuous electrically conducting connection with said common contact body and has at least one sliding contact that is in electrically conducting connection with said selective contact body or that touches said sliding area depending on a positioning thereof when moved; and an actuating member that, upon actuation thereof, slidingly moves said at least one sliding contact of said contactor on a sliding path from said contact surface of said selective contact body into said sliding area and/or out of said sliding area to said contact surface of said selective contact body, zones being formed in said sliding path that are not contacted by said sliding contact when said sliding contact of said contactor transits the sliding area.

2. An electrical sliding contact switch according to claim 1, wherein least one rib or one groove is arranged in said sliding area.

3. An electrical sliding contact switch according to claim 1, wherein said contactor is elastically deformed when said actuating member is actuated.

4. An electrical sliding contact switch according to claim 1, wherein said actuating member and said contactor automatically return to their initial positions after actuation of the actuating member.

5. An electrical sliding contact switch according to claim 1, wherein said sliding contacts of said contactor are disposed in a sliding area between two adjacent selective contact bodies.

6. An electrical sliding contact switch according to claim 1, wherein said sliding path from a first selective contact body to a second selective contact body is embodied largely curved or in a straight line.

7. An electrical sliding contact switch according to claim 1, wherein said contactor has pairs of sliding contacts, a selective contact body being receivable between a respective one of said pairs.

8. An electrical sliding contact switch according to claim 1, wherein said sliding contacts on said contactor include sliding contact fingers.

9. An electrical sliding contact switch according to claim 1, wherein said contact surfaces of said selective contact bodies are arranged annularly and are separated from one another by sliding areas.

10. An electrical sliding contact switch according to claim 2, wherein said contactor is elastically deformed when said actuating member is actuated.

11. An electrical sliding contact switch according to claim 2, wherein said actuating member and said contactor automatically return to their initial positions after actuation of the actuating member.

12. An electrical sliding contact switch according to claim 2, wherein said sliding contacts of said contactor are disposed in a sliding area between two adjacent selective contact bodies.

13. An electrical sliding contact switch according to claim 2, wherein said sliding path from a first selective contact body to a second selective contact body is embodied largely curved or in a straight line.

14. An electrical sliding contact switch according to claim 2, wherein said contactor has pairs of sliding contacts, a selective contact body being receivable between a respective one of said pairs.

15. An electrical sliding contact switch according to claim 2, wherein said sliding contacts on said contactor include sliding contact fingers.

16. An electrical sliding contact switch according to claim 2, wherein said contact surfaces of said selective contact bodies are arranged annularly and are separated from one another by sliding areas.

* * * * *